US008719988B2

(12) United States Patent
Lundin

(10) Patent No.: US 8,719,988 B2
(45) Date of Patent: May 13, 2014

(54) PAINTSCRAPER

(75) Inventor: Peter Lundin, Dvarsatt (SE)

(73) Assignee: Krokoms Vägkrog Aktiebolag, Krokom (SE)

( * ) Notice: Subject to any disclaimer, the term of this patent is extended or adjusted under 35 U.S.C. 154(b) by 845 days.

(21) Appl. No.: 12/442,194

(22) PCT Filed: Sep. 18, 2007

(86) PCT No.: PCT/SE2007/050661
§ 371 (c)(1),
(2), (4) Date: Mar. 20, 2009

(87) PCT Pub. No.: WO2008/036039
PCT Pub. Date: Mar. 27, 2008

(65) Prior Publication Data

US 2010/0005605 A1 Jan. 14, 2010

(30) Foreign Application Priority Data

Sep. 22, 2006 (SE) ..... 0601972

(51) Int. Cl.
*A47L 13/02* (2006.01)

(52) U.S. Cl.
USPC ..... 15/93.1; 15/236.02

(58) Field of Classification Search
USPC ..... 15/93.1, 401, 402, 393, 246.2, 246.3, 15/236.01, 236.07, 236.05
See application file for complete search history.

(56) References Cited

U.S. PATENT DOCUMENTS

| | | | | | |
|---|---|---|---|---|---|
| 2,481,760 | A | * | 9/1949 | Leher | 392/476 |
| 3,079,980 | A | | 3/1963 | Mihm | |
| 3,845,755 | A | | 11/1974 | Aske | |
| 3,935,425 | A | * | 1/1976 | Weissberger et al. | 219/228 |
| 4,768,254 | A | * | 9/1988 | Bell | 15/236.01 |
| 4,836,858 | A | | 6/1989 | Reinhart | |
| 4,947,515 | A | * | 8/1990 | Ivarsson | 15/401 |
| 5,072,486 | A | * | 12/1991 | Guarascio | 15/401 |
| 5,455,981 | A | * | 10/1995 | Wiese | 15/236.01 |
| 5,575,035 | A | * | 11/1996 | Reis et al. | 15/324 |
| 5,850,657 | A | * | 12/1998 | List et al. | 15/105 |

FOREIGN PATENT DOCUMENTS

| | | |
|---|---|---|
| GB | 2261596 | 5/1993 |
| GB | 2297710 | 8/1996 |
| GB | 2320219 | 6/1998 |
| JP | 08230400 A | 9/1996 |

(Continued)

OTHER PUBLICATIONS

International Search Report dated Dec. 7, 2007, in PCT application.

(Continued)

*Primary Examiner* — Dung Van Nguyen
(74) *Attorney, Agent, or Firm* — Young & Thompson

(57) ABSTRACT

A paint stripper (1) for scraping away paint includes a stripper blade that has a handle (2). The paint stripper is characterized by a combination of causing the stripper blade (3) to move in a forward direction (A) and a return direction (B) generally parallel with the longitudinal direction of the handle (2). The stripper (1) includes hot air generating elements such in that the hot air is intended to exit in the vicinity of the blade (3) of the stripper, wherewith paint that has been heated by the hot air is scraped away in response to movement of the blade (3).

11 Claims, 4 Drawing Sheets

(56) References Cited

FOREIGN PATENT DOCUMENTS

| | | | |
|---|---|---|---|
| JP | 2000501030 | A | 2/2000 |
| JP | 2001334799 | A | 12/2001 |
| WO | 8910850 | | 11/1989 |
| WO | 0160564 | | 8/2001 |

OTHER PUBLICATIONS

Japanese Office Action dated Aug. 3, 2012, from corresponding JP application.

* cited by examiner

PAINTSCRAPER

The present invention relates to a paint stripper for scraping off paint, for instance scraping paint from a building structure or from furniture.

When surfaces are to be re-painted, for instance wooden surfaces, it is beneficial to remove old paint for several reasons. Firstly, the old paint can be loosened from the under surface after repainting the surface, wherewith the new paint will also disappear. Secondly paint may be loosened from parts of the underlying surface, resulting in an uneven surface. Consequently a large amount of time is taken up by pre-work in the form of removing old paint but only removal of parts of the paint from said surface prior to repainting. Conventionally, old paint is removed simply by scraping the surface with a stripper. Thus, there is removed old paint that is seated poorly on the surface to be repainted. Another common method is to first move a heating pistol over the surface with old paint, and then scrape the paint away.

These known techniques incur several problems. A first problem is that scraping of the surface results only in partial removal of the paint. The paint that at the time of scraping is seated hard against the underlying surface will not be loosened. However, the paint can be loosened after the new paint has been applied to the surface. A second problem is that when a surface is scraped free from old paint the force required to achieve is very large. The surface from which paint shall be removed is normally very large, wherewith the work involved can result in wear and tear on, for instance, wrists, arms, shoulders and the spine of the person involved in the scraping work. A third problem is that it is necessary to scrape off the paint effectively, so as to loosen old paint, that does not sit properly against the underlying surface, which is time consuming. This preliminary work takes a long time to carry out. A fourth problem is that when hot air is used to warm up the paint, there are required two hands for first heating the paint and scraping away the paint within a certain period.

The present invention solves the problems described above.

The present invention thus relates to a paint stripper 1 that includes a paint scraping blade and a handle 2, and is characterized by a combination in which the scrape blade 3 of the stripper is intended to be moved forwards A and backwards B in a direction generally parallel with the longitudinal direction of the handle 2, in that the paint stripper 1 includes means for generating hot air or warm air, in that the hot air is arranged to flow out in connection with the blade 3 of the stripper 1, wherewith movement of the blade 3 scrapes away paint that has been heated by the warm or hot air.

The present invention thus relates to a stripper 1 for scraping away paint. The stripper includes a scraping blade 3 with a handle 2.

Figure 1:
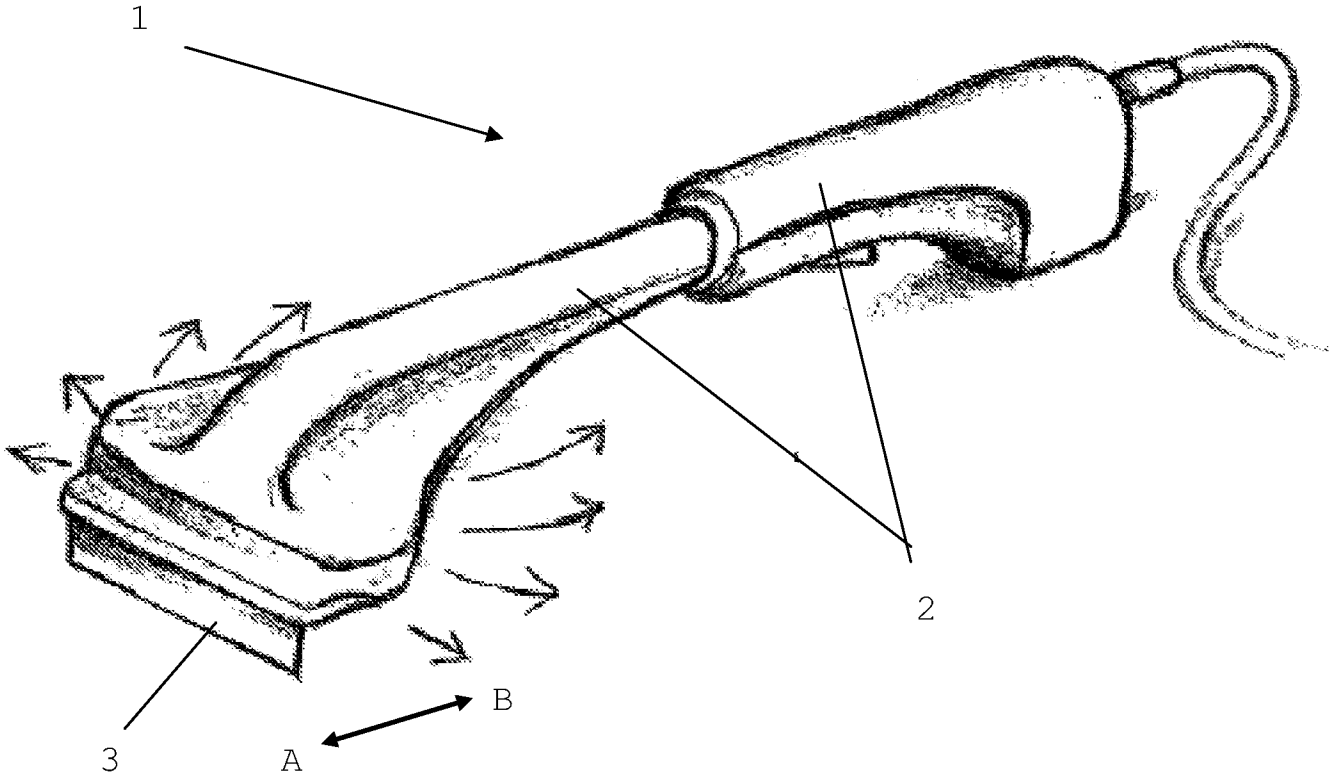
FIG. 1 is an overview of a paint stripper.

FIG. 1 shows in accordance with the invention, a combination in which the blade 3 of the stripper is intended to be moved in a forward A and a return movement B in a direction essentially parallel with the longitudinal direction of the handle 2. A device for generating warm or hot air is included in the stripper 1, which device is suitably of the type used with so-called hot-air-guns. The hot air is intended to exit in the vicinity of the blade 3 of the stripper, wherewith the movement of the blade 3 results in paint heated by the warm air being scraped away.

The temperature of the warm air will preferably lie in a temperature range at which a painted surface from which the paint is to be removed is heated by the warm air to an extent at which the paint loosens from the underlying surface to a degree at which the old paint can be scraped away with the stripper 1. According to a preferred embodiment of the invention the temperature of the hot air will range between 100-800 degrees C., preferably between 300-600 degrees C. inclusive. It is conceivable that different temperature levels will be required by the heat generating device, depending on the type of paint to be scraped off and the sensitivity of the painted surface, and so on.

Figure 2:
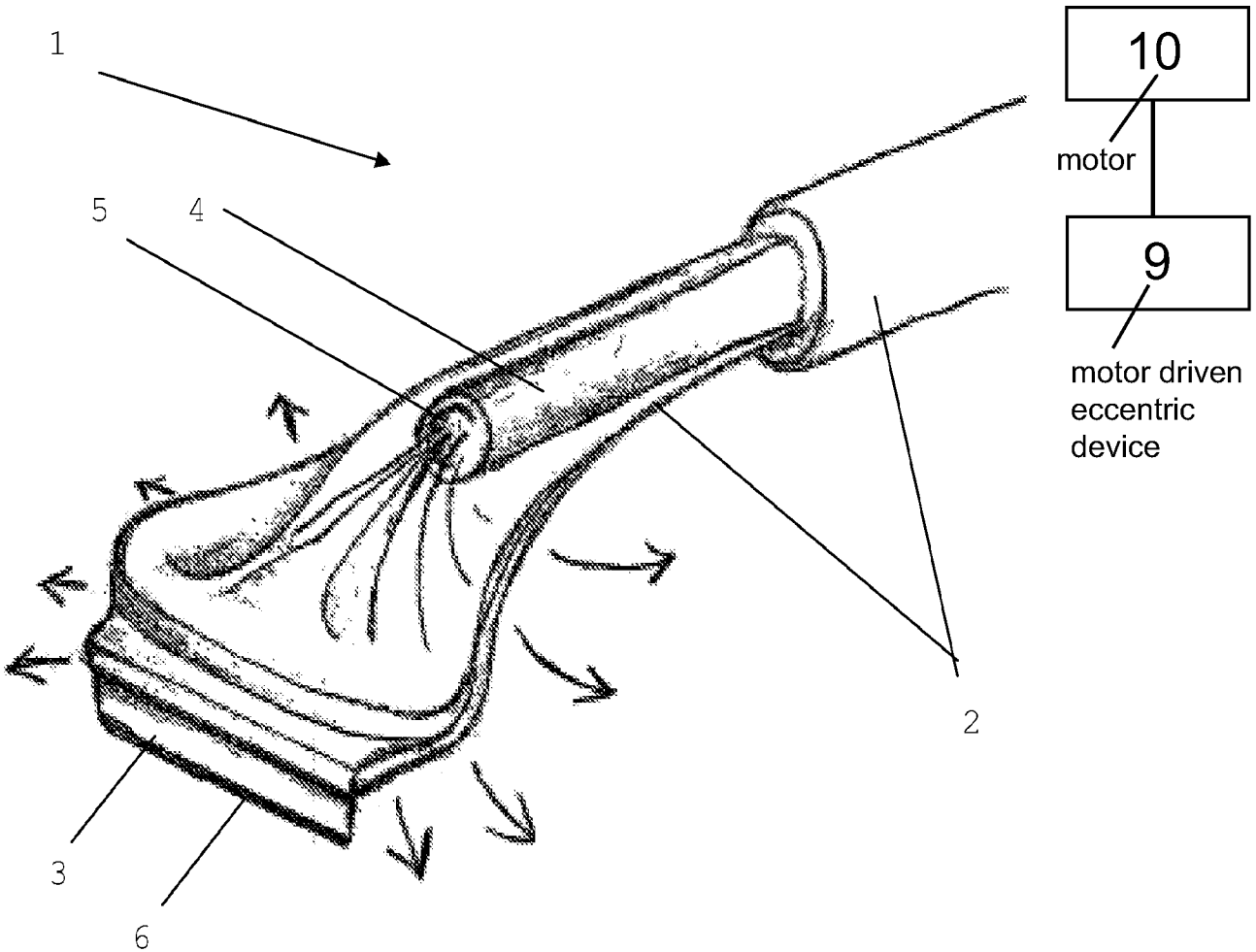
FIG. 2 illustrates an enlargement of the paint stripper partially within the stripper.
Figure 4:
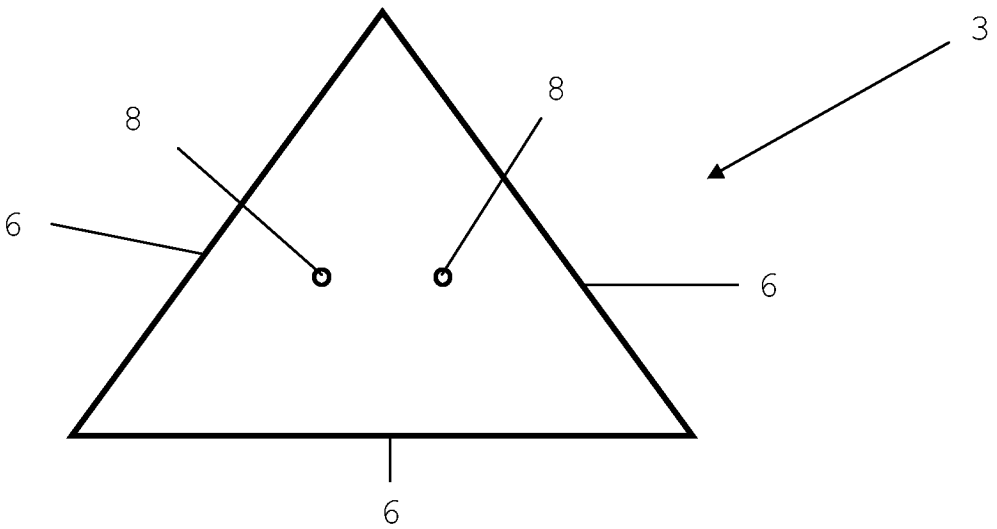
FIG. 4 illustrates an example of the stripper blade configuration.

FIG. 2 illustrates a preferred embodiment in which hot air is intended to exit through a channel 4 disposed through the handle 2 at the free end 5 of the channel 4 located adjacent the blade 3 of the stripper. The scraping blade 3 can be affixed to the stripper in a suitable and convenient manner. The blade 3 is preferably adapted to be fastened mechanically to the stripper 1, for instance with the aid of a screw and nut joint 8 evident from FIG. 4. The scraping blade 3 may, for instance, be provided with several edges 6, for instance with two or three edges on each blade 3. This enables several edges 6 on a stripper blade 3 to be used before needing to change or sharpen the blade. The use of several edges 6 on the stripper blade 3 enables the paint stripper 1 to be turned in several directions, wherewith the channel 4 from which hot air exits can be placed so that the channel will open out in connection with the edge 6 on the stripper blade 3 relevant at that moment.

To facilitate the removal of paint, the edge 6 of the blade 3 may be configured in several ways. According to one preferred embodiment of the invention, the edge 6 of the blade 3 has a v-shaped cross-section. The edge 6 may be configured in some other appropriate fashion in order to achieve maximum removal of paint when scraping the paint surface.

Figure 3:
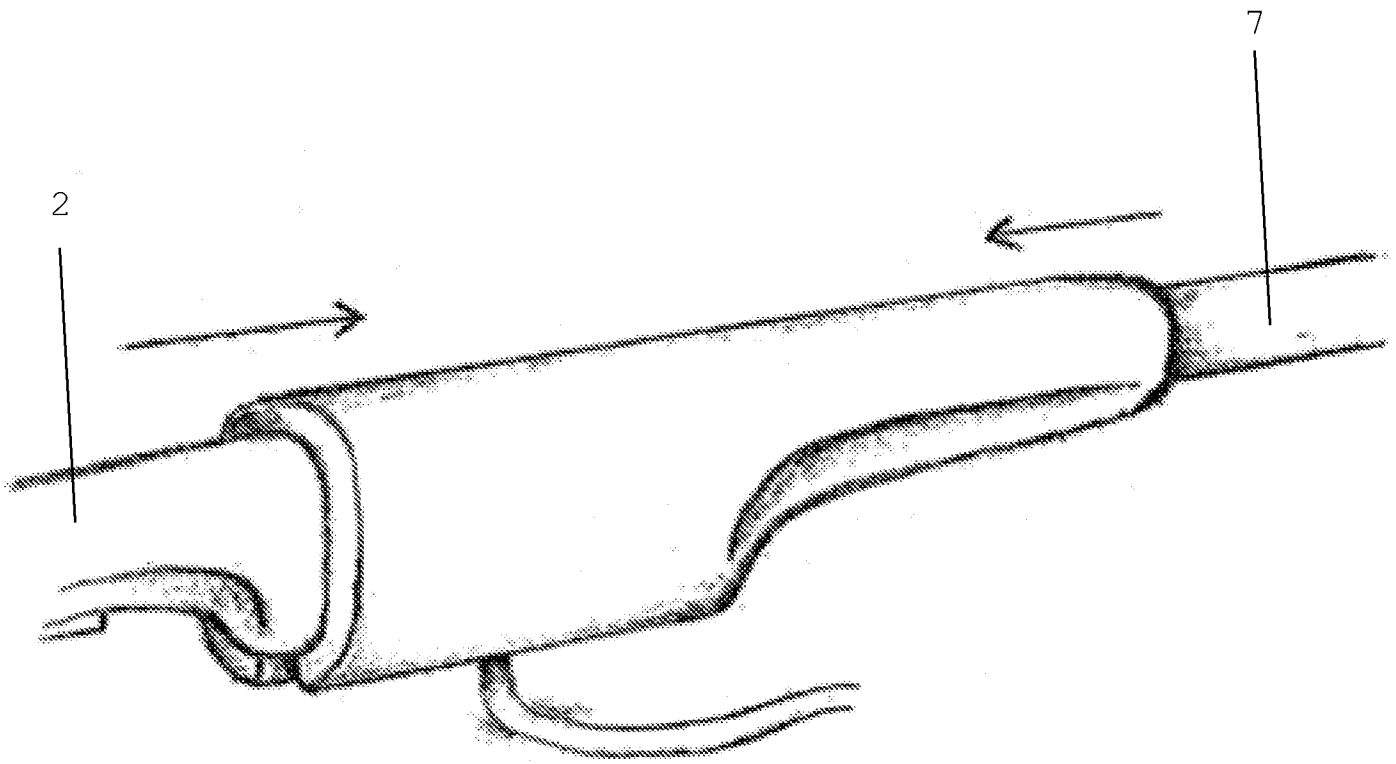
FIG. 3 illustrates a lengthening handle fastened to the stripper handle.

It is often the case that paint to be scraped away from surfaces is not readily accessible to the work man, for example in the case of buildings. According to a preferred embodiment of the stripper 1 illustrated in FIG. 3 the stripper can be fastened to an extension shaft 7 with the aid of a snap-on catch for instance.

According to a preferred embodiment, the reciprocal movement A and B of the scraper 1 is achieved with a generally known motor driven eccentric device 9, driven by motor 10.

According to one preferred embodiment, the stripper 1 is intended to be moved forwards A and backwards B with an amplitude of about 1-15 mm, preferably 1-10 mm.

According to a preferred embodiment, the hot air generating device has a power between 1000 and 2500 W.

A number of methods and uses have been described above. However, the paint stripper 1, the handle 2 and the stripper blade 3 may be configured in some other appropriate manner without departing from the basic concept of the invention.

The present invention is thus not restricted to the methods described above but can be varied within the scope of the accompanying claims.

The invention claimed is:

1. A paint stripper (1) for scraping away paint comprising:

a paint scraping blade (3) having a handle (2), the paint scraping blade being mounted to the handle so that the paint scraping blade is principally perpendicular to a longitudinal direction of the handle (2);

a device for generating hot air which is intended to flow out in the vicinity of the paint scraping blade (3); and a motor arranged to move the paint scraping blade (3) forwards (A) and backwards (B), in a reciprocal manner, in a direction generally parallel to the longitudinal direction of the handle (2), the paint scraping blade (3) being principally perpendicular to the forwards (A) and backwards (B) moving direction, wherein, the movement of the paint scraping blade (3) results in the removal of paint that has been heated by the hot air, the device for generating hot air comprises a channel (4) disposed through the handle (2), the channel (4) having a free end (2) located adjacent the paint scraping blade (3), in use, the hot air flowing through the channel and exiting through the free end (5) of the channel (4) adjacent the paint scraping blade (3) of the stripper at a temperature of 300-600 degrees C.

2. A paint stripper (1) according to claim 1, wherein an edge (6) of the paint scraping blade (3) has a v-shaped cross-section.

3. A paint stripper (1) according to claim 1, wherein the stripper can be attached to a lengthening shaft (7).

4. A paint stripper (1) according to claim 1, wherein the forward movement (A) and the return movement (B) of the stripper is achieved with the aid of the motor driving an eccentric device.

5. A paint stripper (1) according to claim 1, wherein the stripper is adapted to be moved in a forward direction (A) and in a reverse direction (B) at an amplitude of about 1-15 mm.

6. A paint stripper (1) according to claim 5, wherein the hot air generating device has a power of between 1000 and 2500 W.

7. A paint stripper (1) according to claim 1, wherein the hot air generating device has a power of between 1000 and 2500 W.

8. A paint stripper (1) for scraping away paint, comprising:

a paint scraping blade (3);

a handle (2) having a longitudinal direction and a channel (4) disposed therethrough, the channel having a free end (5) located adjacent the paint scraping blade (3), the paint scraping blade mounted to the handle so that the paint scraping blade is principally perpendicular to the longitudinal direction of the handle, and so that the paint scraping blade, in use, is moved forwards (A) and backwards (B) in a direction generally parallel to the longitudinal direction of the handle (2);

a device for generating hot air, an outlet of the device arranged so that, in use, the hot air exits through the free end (5) of the channel (4) of the handle and flows out in a vicinity of the paint scraping blade (3), the hot air having a temperature of 300-600 degrees C.; and a motor arranged to move the paint scraping blade (3) forwards (A) and backwards (B) in a reciprocal manner so that the paint scraping blade (3) moves forwards (A) and backwards (B) in the direction generally parallel to the longitudinal direction of the handle (2) with the paint scraping blade (3) principally perpendicular to the forwards (A) and backwards (B) moving direction, wherein, in use, movement of the paint scraping blade (3) in the reciprocal manner results in removal of paint that has been heated by the hot air.

9. A paint stripper (1) according to claim 8, wherein the paint scrapping blade is adapted to be moved by the motor in a forward direction (A) and in a reverse direction (B) at an amplitude of about 1-15 mm.

10. A paint stripper (1) according to claim 9, wherein the hot air generating device has a power of between 1000 and 2500 W.

11. A paint stripper (1) according to claim 8, wherein the hot air generating device has a power of between 1000 and 2500 W.

* * * * *

UNITED STATES PATENT AND TRADEMARK OFFICE

CERTIFICATE OF CORRECTION

PATENT NO. : 8,719,988 B2
APPLICATION NO. : 12/442194
DATED : May 13, 2014
INVENTOR(S) : Peter Lundin It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 303 days.

Signed and Sealed this
Twenty-ninth Day of September, 2015

Michelle K. Lee

Michelle K. Lee
*Director of the United States Patent and Trademark Office*